United States Patent [19]

Sanders et al.

[11] Patent Number: 4,795,059

[45] Date of Patent: Jan. 3, 1989

[54] METHOD AND APPARATUS FOR SIMULTANEOUS AND CONTINUOUS DELIVERY OF LIQUIDS FROM A PLURALITY OF INDIVIDUAL CONTAINERS TO A DISPENSING DEVICE

[75] Inventors: Charles B. Sanders, Cedar Grove; Clark Bow, Newton; Ralph DeVito, Stanhope; Louis S. Hoffman, Morristown, all of N.J.

[73] Assignee: American Cyanamid Company, Stamford, Conn.

[21] Appl. No.: 121,680

[22] Filed: Nov. 17, 1987

[51] Int. Cl.[4] ..... B67D 3/00

[52] U.S. Cl. ..... 222/1; 222/83.5; 222/88; 222/89; 222/145; 222/183; 222/185; 141/18; 141/329

[58] Field of Search ..... 222/1, 5, 80, 81, 83, 222/83.5, 85, 86, 88, 89, 90, 129, 132, 183, 185, 465.1, 175; 141/18, 329, 330; 206/521, 523

[56] References Cited

U.S. PATENT DOCUMENTS

| | | | |
|---|---|---|---|
| 1,979,323 | 11/1934 | Felesina et al. | 222/88 X |
| 2,203,710 | 6/1940 | Young | 222/90 X |
| 2,259,863 | 10/1941 | Smith, Jr. | 222/88 |
| 2,547,311 | 4/1951 | Genovese | 222/86 |
| 2,774,393 | 12/1956 | Swan | 222/129 X |
| 3,103,278 | 9/1963 | Kuzma et al. | 206/433 |
| 3,139,219 | 6/1964 | Gran | 222/131 |
| 3,608,782 | 9/1971 | Sathicq | 222/145 X |
| 3,620,414 | 11/1971 | Philipps | 222/145 X |
| 3,757,339 | 9/1973 | Banta | 206/3 |
| 3,940,018 | 2/1976 | Scholle | 222/1 |
| 4,098,431 | 7/1978 | Palmer et al. | 222/88 X |
| 4,197,942 | 4/1980 | Gacki et al. | 206/219 |
| 4,523,698 | 6/1985 | Kienlein et al. | 222/80 X |
| 4,557,399 | 12/1985 | Redick, Jr. | 222/83.5 |

FOREIGN PATENT DOCUMENTS

| | | | |
|---|---|---|---|
| 581171 | 8/1959 | Canada | 222/145 |
| 395353 | 2/1909 | France | 222/86 |

*Primary Examiner*—Kevin P. Shaver

*Attorney, Agent, or Firm*—F. Eugene Davis, IV

[57] ABSTRACT

The present invention provides a method and apparatus for continuous delivery of a liquid from individual liquid holding containers to a common discharge outlet. A bulk package is adapted to removably store a plurality of sealed liquid containers in predetermined positions within the package. The top surface of the package defines a plurality of openings for exposing the tops of the individual containers stored within the package. A removable lid includes a plurality of sharp discharge outlets or hollow spikes corresponding in number and disposed in alignment with the openings defined on the top surface of the package. The sharp discharge outlets extend from the lower surface of the lid, and are employed to puncture the openings in the individual containers stored within the package. The lid itself defines a hollow chamber providing a reservoir for receiving the flow of liquid from the individual containers. A harness support is provided to encase the outer periphery of the package and includes a clamp for driving the top lid into the upper surface of the package for puncturing the sealed openings of the individual containers stored within the package. The package can be supported by the harness in an inverted position to result in simultaneous flow of liquid from the individual containers into the hollow reservoir defined in the lid.

20 Claims, 5 Drawing Sheets

24
64
20
26
24
28
32
22
26
34
64
2
8
70
4
24
28
22
26
34
14

16
2
72
24

26
26
26
34
24

24
24
66

2

2
68

METHOD AND APPARATUS FOR SIMULTANEOUS AND CONTINUOUS DELIVERY OF LIQUIDS FROM A PLURALITY OF INDIVIDUAL CONTAINERS TO A DISPENSING DEVICE

BACKGROUND OF THE INVENTION

The present invention relates to an improved package for providing simultaneous and continuous delivery of liquids from individual containers stored within the package. The invention also provides novel supporting means for the overall package structure in which the supporting means are also adapted to provide the required mechanical force for unsealing the individual liquid containers housed within the package.

Methods and apparatus for storing and dispensing liquid from individual containers are well-known to the prior art. However, each of the known devices exhibits certain notable drawbacks. In particular, the liquid holding containers are initially positioned in an inverted position and liquid is discharged therefrom due to gravitational forces immediately after the containers are unsealed. Examples of this type of prior art are disclosed in U.S. Pat. Nos. 3,139,219; 3,940,018; 4,197,942; and 4,557,399. Accordingly, such devices may not be readily transported once the liquid holding containers have been unsealed. Additionally, the known prior art discloses no portable systems which may be easily transported to and supported from different locations of use.

It is an object of the present invention to provide a method and apparatus for continuous and simultaneous delivery of liquid from individual containers in a portable package which such liquid delivery may be deferred even after the individual containers have been punctured.

It is a further object of the present invention to provide such method and apparatus including supporting means for the portable package by which the package may be readily transported from one location to another and readily mounted to a desired position.

It is still a further object of the present invention to provide a method and apparatus in which the aforementioned supporting means also cooperate with the package structure to provide the required mechanical force for puncturing or unsealing the individual liquid holding containers when continuous delivery of the liquid is required.

Other objects and advantages of the present invention will become apparent from the following description.

SUMMARY OF THE INVENTION

The present invention provides a package structure for housing a plurality of individual liquid holding containers. The package is formed from an upper portion mounted to the top of a bottom portion. The bottom portion includes a closed lower surface and a plurality of partitions extending upwardly into the package for defining a plurality of compartments for holding individual liquid containers. The upper portion of the package includes a top surface defining a plurality of openings aligned with the nozzles of the liquid containers for exposing the same. The top portion is mounted to the bottom portion of the package by complimentary, interfitting lips defined on the intersecting rims of the two portions.

A lid portion is adapted to be mounted over the upper surface of the top portion of the package. A plurality of hollow spikes are formed on the lower surface of the lid and extend downwardly therefrom. The number of spikes corresponds to the number of openings defined in the top portion of the package, and the spikes are in alignment with the openings. The lid defines a hollow chamber therein, and the plurality of spikes are in fluid communication with this hollow chamber. A single discharge outlet is defined on the top surface of the lid.

In operation, the package structure is mounted within a supporting harness right side up. The lid is gently placed atop the upper portion of the package so that the spikes extending downwardly therefrom are in register with the openings defined in the upper surface of the package. Guide means provided on the package and the lid assure proper alignment. The harness includes a clamp adapted to operate on the lid. When the clamp is pivoted to close the harness, a mechanical force is exerted to drive the lid and the package structure together. As a result of this mechanical force, the downwardly extending hollow spikes on the lower surface of the lid puncture the seals of the individual containers stored within the package. However, because the individual containers are right side up, there will be no automatic delivery of liquid. Accordingly, the package may be transported from one location to another by the supporting harness without loss of liquid even after the liquid holding containers have been punctured.

When liquid delivery is desired, the package is merely inverted resulting in liquid flow from the individual containers into the common reservoir defined within the lid as a result of gravitational forces. Liquid delivery from the lid is provided by the single discharge outlet defined on the top surface of the lid which is now in an inverted position. The supporting harness provides suitable means for mounting the package structure to an overhead support at any desired location where continuous delivery of the liquid is required.

DESCRIPTION OF THE BEST MODE FOR CARRYING OUT THE INVENTION

Figure 1:
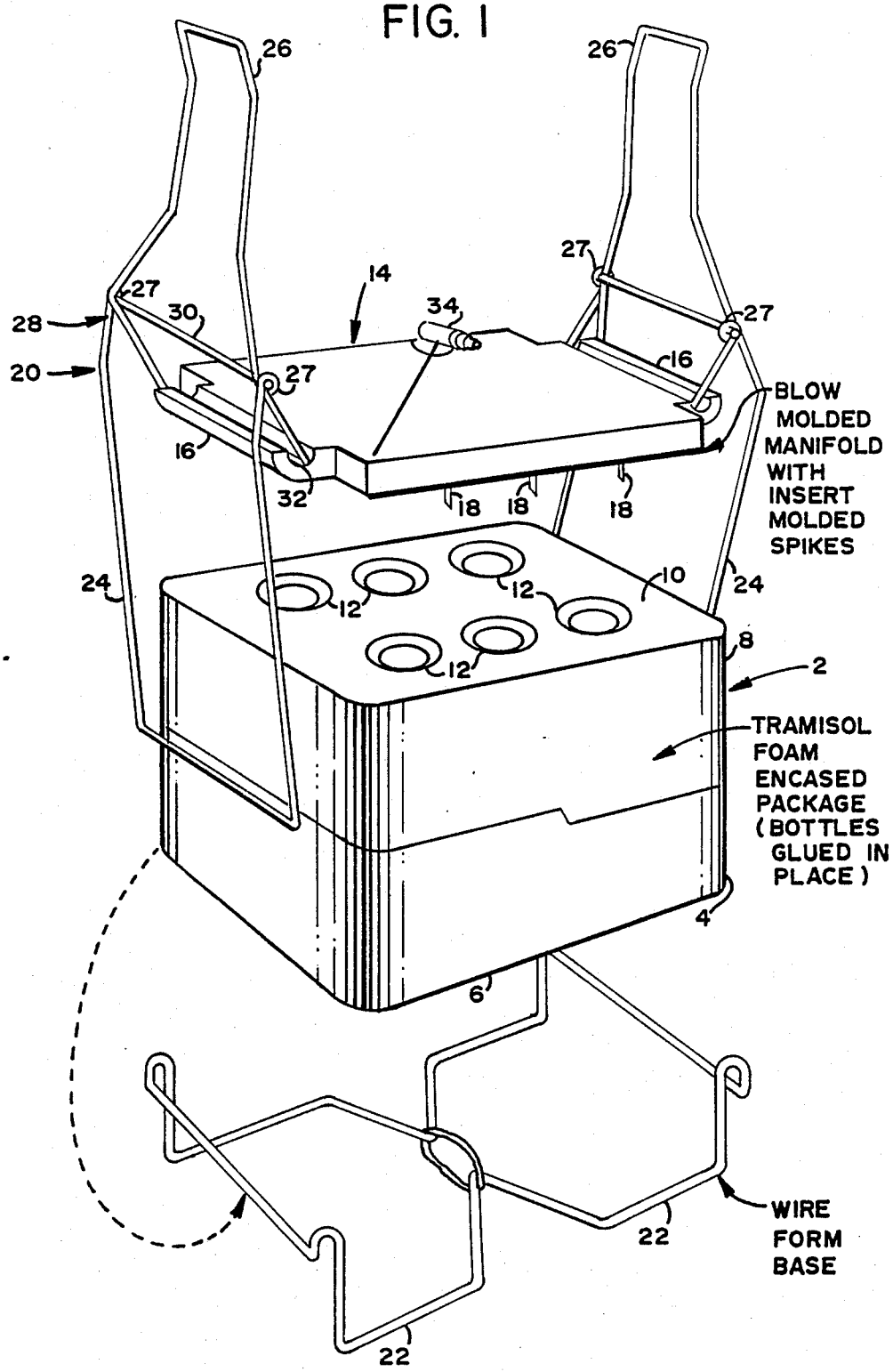
FIG. 1 of the drawings illustrates a perspective view of an assembled packaged structure and an upper lid and harness structure in accordance with the present invention.

Referring now to the drawing figures, FIG. 1 illustrates a perspective view of the assembled package in accordance with the present invention generally designated by the reference numeral 2. The package includes a bottom portion 4 having a closed lower surface 6, and a top portion 8 adapted to be mounted in interfitting relationship over the bottom portion 4. The top surface 10 of the upper package portion 8 defines a plurality of openings designated by reference numeral 12.

Still referring to FIG. 1, an upper lid 14 is shown spaced above the upper portion 8 of the package 2. The lid includes two end portions 16, each of which define a groove. A plurality of pointed hollow tubes 18 (hereinafter referred to as spikes) extend downwardly from the lower surface of the lid in a direction towards the top surface 10 of the upper portion 8 of the package 2. The spikes 18 correspond in number to the openings 12 on the top surface of the package. The spikes are positioned relative to each other so that each spike 18 is in registration with the central portion of a different one of the openings 12 defined on upper surface 10 of the package when the lid is placed on the package. As will be discussed with respect to FIG. 5, the package 2 and the lid 14 can be provided with guide means to assure alignment between the spikes 18 and the openings 12.

FIG. 1 further illustrates a harness structure generally designated by the reference numeral 20. The harness is preferably formed from metal and includes a base portion 22 adapted to receive the bottom surface 6 of the lower package portion 4, intermediate members 24 which abut against and retain the end portions of the package 2, and pivotal handle members 26. As illustrated in FIG. 1, the base may be selectively disassembled from the remaining portions of the harness structure. In a similar manner, although not shown in the drawing, the handle members 26 may be disassembled from the intermediate members 24 of the harness. Although the harness structure shown in FIG. 1 is formed from different components removably assembled together, the harness may also be formed as a single permanently assembled unit as shown in FIG. 5. The single unit is preferable since it does not require assembly each time it is used.

A frame designated as reference numeral 28 extends at about a right angle from each handle member 26 and comprises transverse crossbar members 30 and 32. The upper crossbar member 30 is received within two opposed loops 27 defined at the upper end of the intermediate harness piece 24 so as to enable the handle 26 and frame 28 to pivot relative to the intermediate harness section 24. The lower cross bar members 32 are received within the grooves defined on the end portions 16 of the top surface of the lid 14. It is now apparent that when the sections 22, 24 and 26 of the harness 20 are assembled and the handle portions 26 are pivoted inwardly toward the top surface of the lid, a force is generated which drives the lid into the upper portion 8 of the package 2. Accordingly, the aligned downwardly extending spikes 18 on the lower surface of the lid are driven into the openings 12 on the upper surface of the package to puncture the exposed seals on the individual containers housed within the package 2. As will be discussed in greater detail below, the spikes 18 provide fluid flow paths for liquid from the individual containers in the package into a common reservoir defined within the lid 14 as well as providing vents to allow air into the individual containers. The liquid thereafter may be discharged from this common reservoir via a single discharge opening 34 on the upper surface of the lid 14 which is in communication with the reservoir defined within the lid.

As noted above, the harness structure is preferably formed from a durable metal. The package structure itself, including both the bottom portion 4 and the upper portion 8 may be economically manufactured from Styrofoam, and the lid 14 is preferably formed from plastic.

Figure 2:
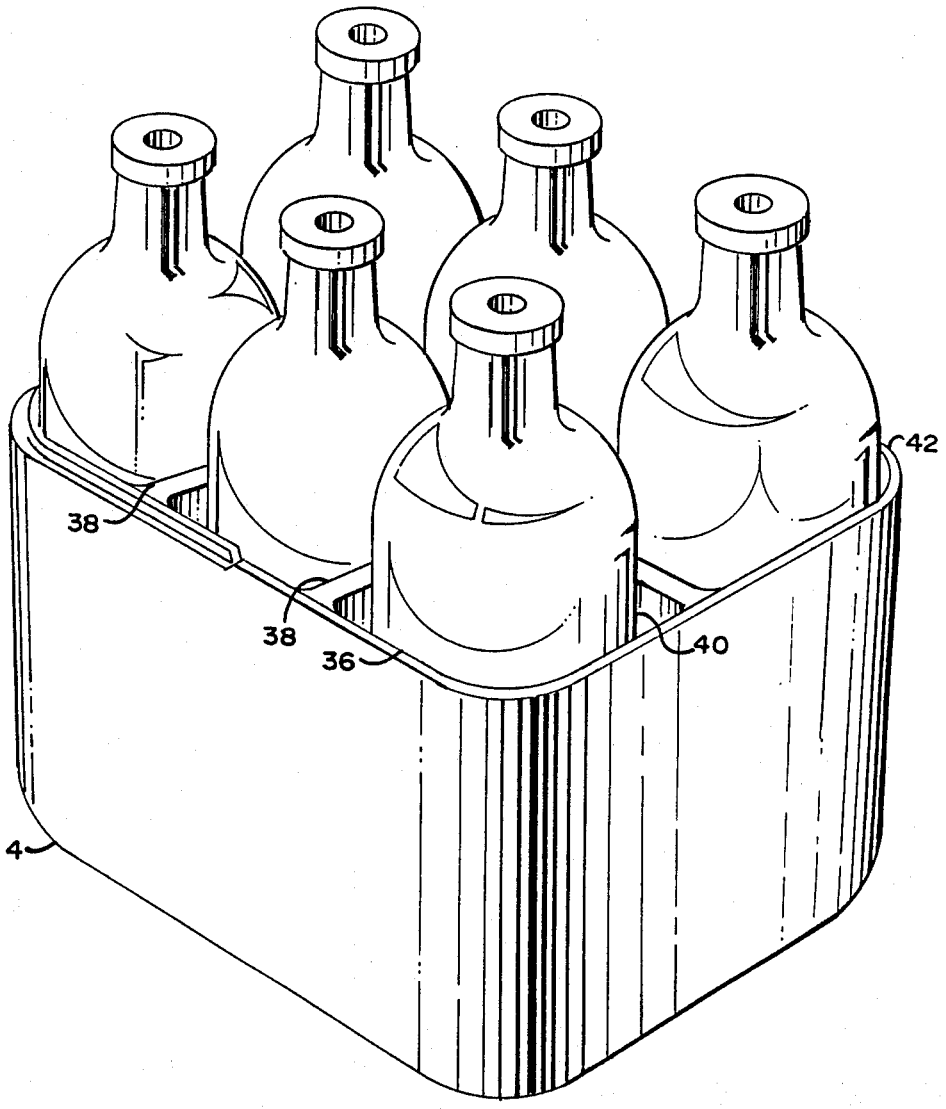
FIG. 2 of the drawings illustrates a perspective view of only the lower portion of the package shown in FIG. 1 holding a plurality of individual liquid containers.

Referring now to FIG. 2 of the drawings, a perspective view of the lower portion 4 of the package 2 is illustrated. As seen from the drawing figure, the internal space defined by the bottom portion 4 is divided into a plurality of compartments 36 by partition members 38. Each compartment is adapted to store a single container 40 holding a liquid to be dispensed. The containers are supported in bottom portion 4 by the closed lower surface 6 (FIG. 1). The embodiment illustrated by FIG. 2 defines six (6) separate storage compartments and is illustrated as housing six (6) separate liquid containers 40. If desired, the containers may be glued into their respective compartments. The upper rim of the bottom portion of the package defines a circumferential lip 42. This lip is provided to interfit with a corresponding downwardly extending lip on the lower rim of the upper package portion 8 to interlock the upper and lower portions into the assembled package structure 2. If desired, the upper and lower package portions may also be glued together at their intersecting rims.

Figure 3:
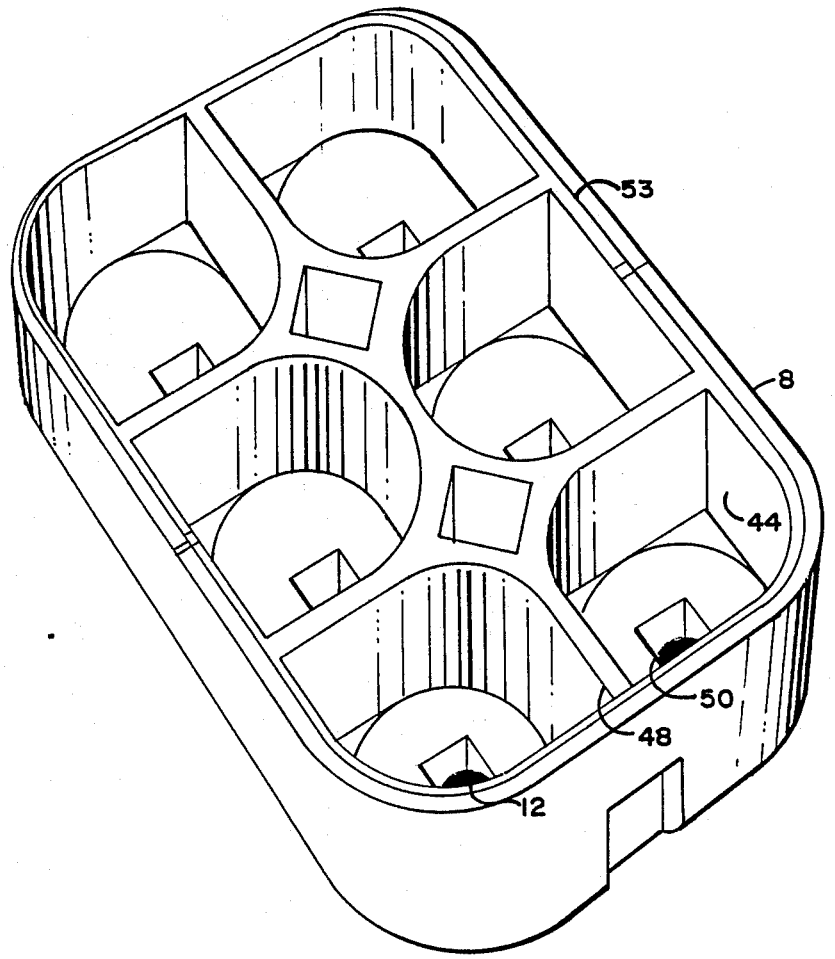
FIG. 3 illustrates a perspective view of only the upper portion of the package shown in FIG. 1 in an inverted position.

FIG. 3 of the drawings illustrates an inverted perspective view of the upper portion 8 of the package structure. The internal area of the upper portion 8 is divided into a plurality of compartments 44 by partitions 48. The compartments and partitions in the upper portion 8 correspond in number and configuration to the compartments and partitions in the lower portion 4 so that they are in registration when the package is assembled. The top of each compartment 44 defines a square recessed area 50 to provide retaining means for the nozzle portion of a liquid container 40. The recessed portions 50 terminate in the circular openings 12 defined on the upper surface 10 (see FIG. 1) so as to expose the sealed top of the nozzles of each liquid container 40. Circumferential lip 53 on the lower rim of the top package portion 8 complements the lip 42 defined on the lower package portion 4 to help secure the assembled package 2 together.

Figure 4:
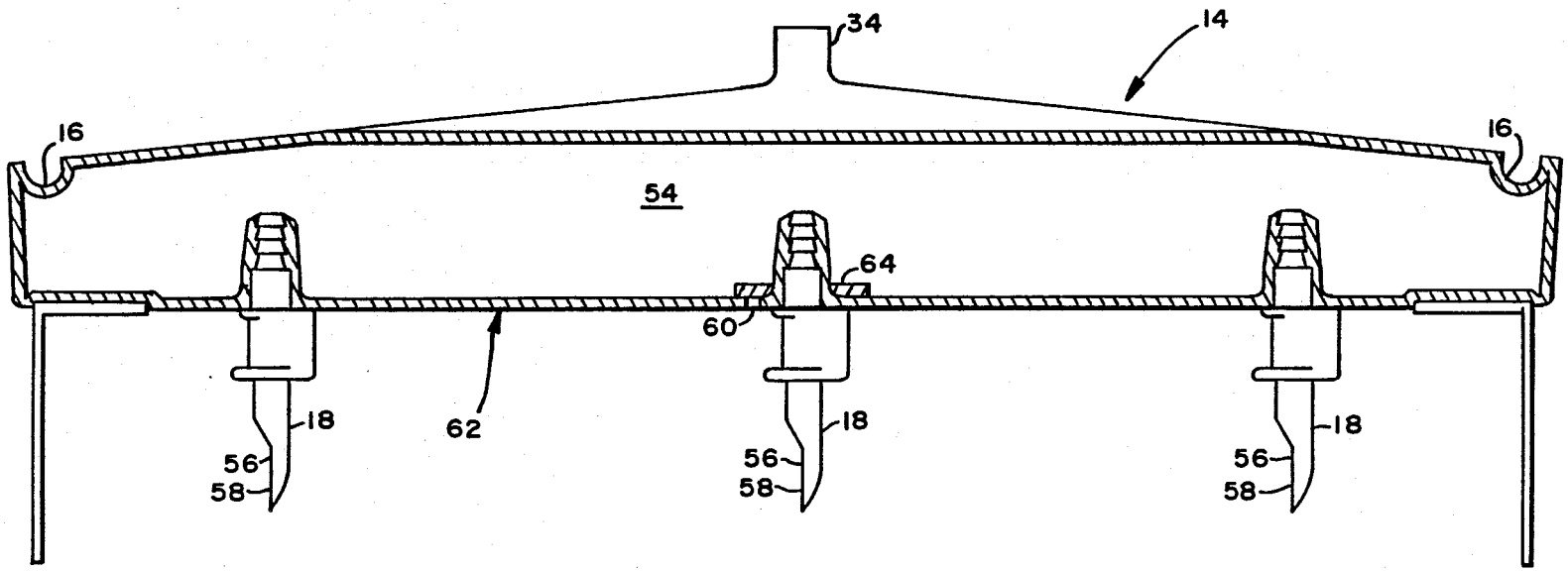
FIG. 4 illustrates a sectional view taken through the lid portion of the package structure in accordance with the present invention.

FIG. 4 iilustrates a section taken through lid 14. As previously discussed with respect to FIG. 1, the end portions 16 of the upper surface of the lid 14 define grooves for receiving crossbars extending from the pivotal handles 26 of the harness structure 20. The hollow spikes 18 extending downwardly from the lower surface 62 of the lid 14 are adapted to puncture the seals covering the nozzles of the containers 40 stored in the package 2 and thereby provide a fluid flow path between each of the containers 40 and a common reservoir or hollow chamber 54 defined within the lid 14. Each spike 18 defines two openings or ports 56 and 58. One opening is provided for fluid flow of liquid between the containers and the hollow chamber within the lid, and the second opening is provided for venting of air to break a vacuum which might otherwise impede fluid flow. A small opening 60 is also defined in the center of the lower lid surface 62 for venting purposes. A flapper 64 is mounted behind this central opening 60 in the hollow chamber 54 to permit one-way flow of air into the chamber 54 but will not permit leakage of liquid therefrom. Liquid received in the chamber 54 may be discharged from the lid 14 through the discharge outlet 34.

Figures 5A, 5B, 5C, 5D, 5E, 5F:
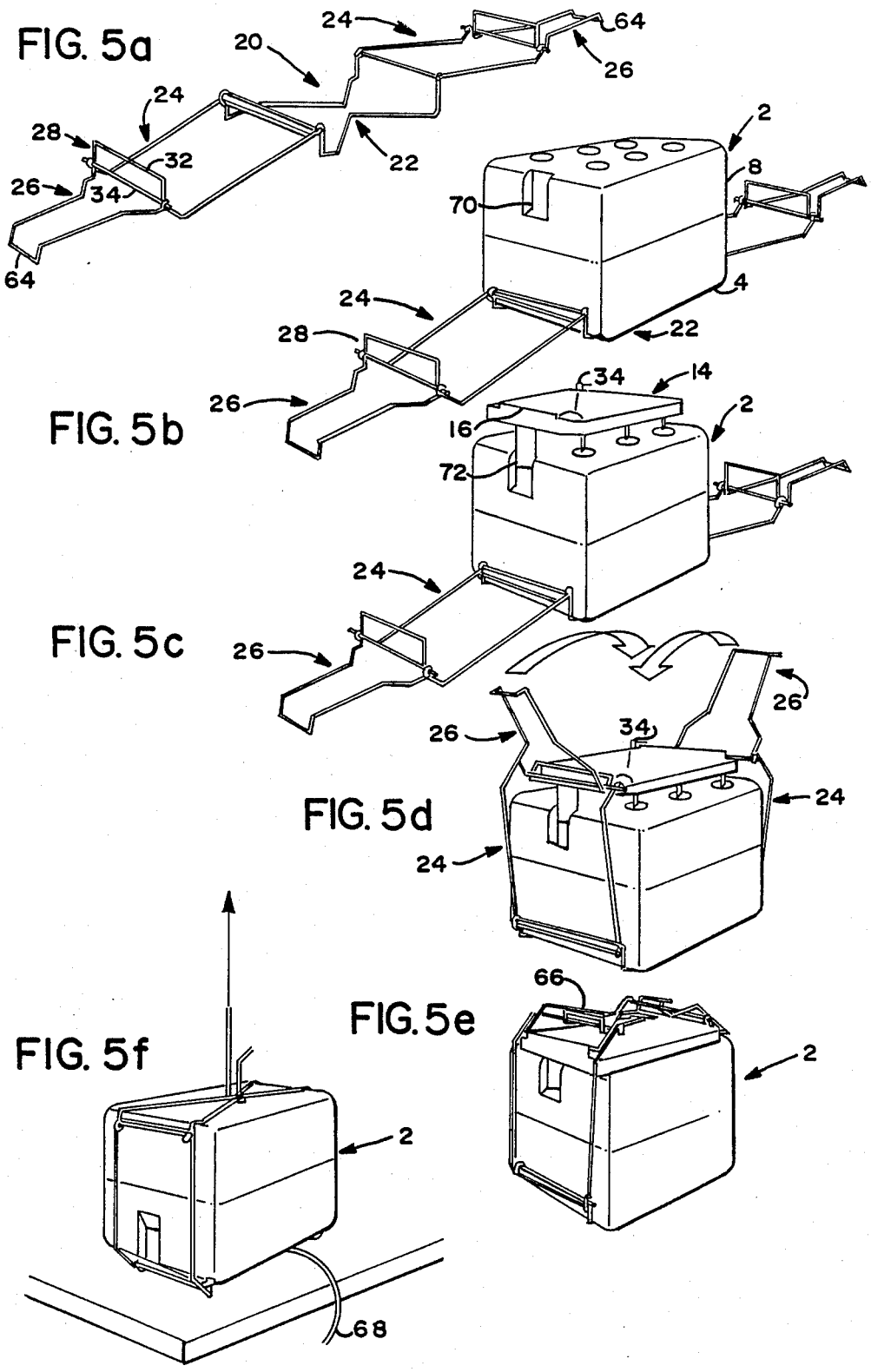
FIGS. 5*a*–5*f* illustrate the sequence in which the harness and lid are mounted to the assembled package to provide continuous liquid delivery from the individual containers housed within the package.

FIGS. 5*a* through 5*f* illustrate the sequence by which the package of the present invention is placed in operation for the continuous and simultaneous delivery of liquid. FIG. 5*a* illustrates a unitary permanently assembled harness structure 20 including the base portion 22, intermediate portions 24 pivotally mounted to the respective ends of the base portion, and handles 26 pivotally mounted to the respective ends of the intermediate portions. As noted in the discussion of FIG. 1, the handle portion includes an angularly extending frame 28, including transverse crossbars 32 and 34, integrally defined on the handle and pivotal therewith. The free ends of the handle also define L-shaped tab portions 64 extending substantially at a right angle to the longitudinal portion of the handle and in a plane substantially parallel to the plane of orientation of the frame member 28.

Referring now to FIG. 5*b*, the assembled package structure 2 in accordance with the present invention is received within the base portion 22 of the harness. Thereafter, as shown by FIG. 5*c*, the lid 14 is freely placed atop the package 2 so that blade members 72, which extend downwardly from both ends of the lid 14, are received within indentations 70 defined on the sides of the upper portion of the package 2. The blades 72 and the indentations 70 act as guide means to assure that the spikes 18 of the lid are in alignment with the openings 12 defined on top of the package. Thereafter, as illustrated by FIG. 5*d*, the intermediate harness members 24 are pivoted towards the end walls of the package 2 with the crossbar 32 of the handle 26 received within the grooves defined at the ends 16 of the lid 14. As shown by the directional arrows of FIG. 5*d*, the handles 26 are each pivoted relative to their respective intermediate pieces 24 in a direction towards the top surface of the lid 14. As the handles are folded inwardly against the lid, a mechanical force driving the lid into the package results from the force exerted by the perpendicularly oriented crossbar 32 against the lid 14. As discussed above, driving the lid against the package causes the spikes 18 to penetrate the nozzles of the containers within the package through the openings 12 and puncture the seals of the individual containers.

The handle members are thereafter folded completely down against the lid as shown in FIG. 5*e* to close the harness and surround the assembled package structure. The now upwardly extending portion 64 of each of the handles 26 locks into the crossbar 34 of the opposed handle to secure the harness 22 in a closed position as illustrated by reference numeral 66 in FIG. 5*e*. To fascilitate the interlock, one handle may be slightly wider than the other so that the narrower handle is received within the wider handle. The now upwardly oriented space defined between crossbar 34 and end portion 64 of each folded handle provide means for carrying the closed harness and package in an upright position.

Once the above steps have been completed, the closed harness and the enclosed package structure may be inverted as illustrate in FIG. 5*f*. Until the structure is inverted, there will be no liquid flow because the individual containers are upright in the package. Once the structure is inverted, gravitational forces acting on the liquid in each container cause simultaneous liquid flow from each of the containers through the respective hollow spikes 18 and into the common reservoir 34 defined in the lid 14. (As shown in FIG. 5*f*, the closed harness 20 is designed so that the inverted structure may be supported on a stationary surface from below or suspended from an overhead support). Liquid received in the common reservoir 34 is discharged therefrom in one stream through the single discharge outlet 34 defined on the upper surface of the lid 14 which is now inverted. Discharge through the outlet 34 will occur as a result of gravitational forces and/or suction applied to the outlet. A conduit 68 may be coupled to the discharge outlet 34 for delivery of liquid from the package 2 to desired locations away from the package.

It is apparent from the foregoing that the securely closed harness structure may be used to mount the package 2 to suitable supporting means in an inverted position at any desired location. Therefore, the system of the present invention is portable. Additionally, the closed harness maintains the lid 14 securely mounted to the top of the package 2 when the package is in its inverted position for liquid delivery. Likewise, the closed harness assures that the top and bottom portions of the package remain contiguous with each other when the package is inverted. In this manner, the channels of fluid flow between the individual containers housed within the package, and the hollow reservoir defined within the lid 14 remain securely connected.

It is also apparent that even after the package structure is rendered operational for the delivery of liquid by following the sequence described in FIGS. 5*a*–5*e* to complete the fluid flow path from the individual containers in the package to the discharge outlet 34 on the lid, there will be no fluid flow until the package is inverted as disclosed by FIG. 5*f*. In this manner, the structure may be ready for use by completing all fluid flow paths, but delivery of fluid may be deferred until some time in the future, as for example, after the structure has been transported to a different location. Removable cover means may be provided for temporarily sealing the discharge outlet 34 on the lid to prevent any incidental loss of liquid when the device is being transported.

The assembled package 2 illustrated in FIGS. 5*a*–5*f* is identical to the package illustrated in FIG. 1 except for two modifications. First, as briefly noted above, the ends of the upper portion 8 of the package illustrated in FIG. 5 define side indentations 70. The lid 14 includes downwardly extending blade members 72 adapted to be slideably received within the indentations 72 when the lid 14 is placed atop the package 2. In this manner, the indentations 70 and the blade members 72 act as guide means for assuring that the lid 14 can only be forced down on the package 2 when the spikes 18 are aligned with the openings 12. The maintenance of this alignment is important to assure that the hollow spikes 18 will puncture the exposed seals of the containers housed within the package to provide the necessary fluid communication between the package and the liquid reservoir defined within the lid.

The second difference between the structure of FIGS. 1 and 5 is that the harness structure of FIG. 5 is permanently assembled. As noted, this avoids the inconvenience of reassembling the harness each time it is used.

The apparatus disclosed herein may be employed to continuously and simultaneously deliver any type of liquid from individual containers through a common reservoir. The apparatus has been successfully used to store, transport and deliver solutions of liquid medication to an automatic dosing device. The device is especially adapted for the handling and administration of levamisole phosphate injectable e solution sold under the registered trademark TRAMISOL. The use of this anthelmintic in feedlots and other production settings involving the treatment of large numbers of cattle at one time requires a dispenser system having a reasonably large capacity. At present, this treatment solution is marketed in 100 milliliter and 500 milliliter amber glass viles. By using the method and apparatus described herein, the assembled package may house six identically configured 500 milliliter containers of the solution, thereby providing a capacity of three liters. The delivery system provided by the present invention is portable and may be readily transported from one treatment location to another with minimal inconvenience and minimal or no loss of liquid.

The preferred embodiment of the invention illustrated by the drawing depicts a portable delivery system capable of holding six identically configured containers holding the same liquid. However, it is apparent, that a package in accordance with the present invention may be designed to hold a different number of containers, that the containers need not necessarily hold the same liquid, and that the containers need not be of identical configuration or capacity.

Other features and modifications of the method and apparatus disclosed herein will be apparent to those skilled in the art. Accordingly the preferred embodiments of the invention discussed herein are intended to be illustrative only and not restrictive of the scope of the invention, that scope being defined by the following claims and all equivalents thereto.

We claim:

1. An apparatus for providing continuous and simultaneous delivery of liquid from individual containers, said apparatus comprising:

a housing for accommodating a plurality of containers, said housing having an upper surface defining a plurality of openings therein, said plurality of openings corresponding in number and position to said plurality of containers for exposing the upper portion of each container, a lid adapted to be mounted to the upper surface of said housing, said lid including a plurality of tubular members extending downwardly therefrom, said tubular members corresponding in number to said openings in said upper surface of said housing, each of said tubular members being aligned with a different one of said openings, said lid defining a hollow chamber therein, said hollow chamber being coupled in fluid flow relationship to said tubular members, wherein said tubular members each have puncturing means thereon to puncture the upper portion of said individual containers to provide a liquid flow path therethrough between said containers and said hollow chamber defined in said lid.

2. The apparatus of claim 1 further including means for applying a mechanical force to drive said lid against said upper surface of said housing.

3. The apparatus of claim 2 wherein said means for applying said mechanical force comprises a supporting harness adapted to surround the periphery of said housing and said lid when said lid is positioned atop said housing, said supporting harness comprising clamp means for applying said mechanical force.

4. The apparatus of claim 3 wherein said supporting harness is adapted to secure said lid to said upper surface of said housing.

5. The apparatus of claim 3 wherein said supporting harness is adapted to support said housing and said lid from a supporting structure.

6. The apparatus of claim 3 wherein said supporting harness is adapted to transport said housing and said lid.

7. The apparatus of claim 3 wherein said clamp means comprises a pivotable handle having a crossbar received within a groove defined on the upper surface of said lid.

8. The apparatus of claim 1 further including a discharge charge outlet defined on the upper surface of said lid, said discharge outlet adapted to provide continuous delivery of liquid in a single stream from said hollow chamber in said lid when said lid is mounted atop said housing and said housing is inverted.

9. The apparatus of claim 1 wherein the lower surface of said lid defines at least one opening covered by a oneway valve to permit air flow only into said hollow chamber defined in said lid.

10. The apparatus of claim 1 wherein the puncturing means on each of said tubular members compresss a sharp point.

11. The apparatus of claim 1 wherein each of said tubular members defines two openings therein, one of said openings adapted to conduct liquid flow therethrough and the other of said openings adapted to vent air therefrom.

12. The apparatus of claim 1 further including guide means comprising a recess defined on an outer surface of said housing and a member extending downwardly from said lid and adapted to be slideably received in said recess only when said tubular members extending down from said lid are aligned with said openings defined in said upper surface of said housing.

13. An apparatus for providing continuous and simultaneous liquid flow from a plurality of individual containers, said apparatus comprising:

a housing for accommodating a plurality of containers, said housing having an upper surface defining a plurality of openings for exposing the tops of each of said plurality of containers stored within the housing, a lid adapted to be mounted on said upper surface of said housing, said lid including a plurality of spikes extending downwardly therefrom and adapted to puncture the tops of said containers through said openings in said upper surface of said housing, and a supporting harness means to enclose said housing and said lid and for exerting a driving force thereagainst to drive said plurality of spikes into the tops of said containers for puncturing seals on said tops and enabling the release of liquid from said containers when said housing is inverted.

14. The apparatus of claim 13 wherein said supporting harness means includes two pivotable handles each having a crossbar received in the upper surface of said lid for exerting said driving force against said lid when said handles are pivoted in a predetermined direction.

15. The apparatus of claim 14 wherein said two pivotable handles are adapted to releasably interlock into each other to secure said harness means in a closed position when said handles are pivoted in said predetermined direction.

16. The apparatus of claim 13 wherein said lid defines a hollow chamber and said plurality of spikes are hollow and provide fluid communication between each of said individual containers in said housing and said hollow chamber such that liquid from said containers flows through said hollow spikes and into said hollow chamber when said housing is inverted.

17. The apparatus of claim 16 wherein a single discharge outlet is defined on the upper surface of said lid for enabling continuous delivery of liquid in a single stream from said hollow chamber defined in said lid.

18. The apparatus of claim 13 further including guide means comprising a recess defined on an outer surface of said housing and a member extending downwardly from said lid and adapted to be received in said recess only when said plurality of spikes is aligned with said plurality of openings defined in the upper surface of said housing.

19. A method of simultaneously and continuously delivering a liquid from a plurality of different containers, said method comprising the steps of:

providing a housing for accommodating a plurality of containers holding liquids in an upright position, providing openings in said housing for exposing each of the tops of said plurality of containers, mounting, on top of said housing, a lid having downwardly extending hollow means for puncturing in fluid communication with a hollow chamber defined in said lid, driving said. lid into said housing to cause said hollow means for puncturing to puncture the tops of said plurality of containers, securing said lid to said housing, and inverting said lid and said housing to cause liquid from each of said plurality of containers to flow through said hollow means for puncturing and into said hollow chamber in said lid.

20. The method of claim 19 including the step of discharging said liquid from said hollow chamber in said lid through a discharge outlet in a single stream.

* * * * *